United States Patent [19]

Ward

[11] Patent Number: 4,866,833

[45] Date of Patent: Sep. 19, 1989

[54] METHOD OF PRODUCING AN ASSEMBLY HAVING AT LEAST TWO INTERCOMMUNICATING CHAMBERS

[76] Inventor: Alec D. Ward, 23 Saxon Rd., Pakefield, Suffolk, England, NR33 7BS

[21] Appl. No.: 929,713

[22] Filed: Nov. 12, 1986

[30] Foreign Application Priority Data

Nov. 14, 1985 [GB] United Kingdom ..... 8528127

[51] Int. Cl.[4] ..... B23P 9/00; B23P 21/00

[52] U.S. Cl. ..... 29/445; 29/469; 52/79.5; 52/79.8; 135/97; 135/105; 135/107; 135/902

[58] Field of Search ..... 29/469, 445; 52/79.5, 52/79.1, 79.7, 79.8, 745, 79.4; 135/90, 97, 109, 107, 902, 105, 117; 312/1, 3; 600/21

[56] References Cited

U.S. PATENT DOCUMENTS

| | | | |
|---|---|---|---|
| 932,909 | 8/1909 | Saunders | 135/97 |
| 2,440,557 | 4/1948 | Power | 135/90 |
| 2,751,635 | 6/1956 | Donnahue | 52/79.7 X |
| 3,501,213 | 3/1970 | Trexler | 135/1 R |
| 3,699,986 | 10/1972 | Kirkham | 135/1 R |
| 3,785,096 | 1/1974 | Neuhardt | 52/79.4 |
| 3,849,952 | 11/1974 | Hanaoka | 52/79.5 |
| 4,072,158 | 2/1978 | O'Brien et al. | 135/117 X |
| 4,102,352 | 7/1978 | Kirkham | 312/1 |
| 4,133,149 | 1/1979 | Angress | 135/97 X |
| 4,223,690 | 9/1980 | Wera et al. | 135/90 |
| 4,304,224 | 12/1981 | Fortney | 312/1 X |
| 4,409,889 | 10/1983 | Burleson | 52/79.1 X |
| 4,417,527 | 11/1983 | Williams et al. | 52/79.8 X |
| 4,632,138 | 12/1986 | Irwin | 135/109 |
| 4,706,551 | 11/1987 | Schofield | 135/105 X |

FOREIGN PATENT DOCUMENTS

| | | | |
|---|---|---|---|
| 1017520 | 9/1977 | Canada . | |
| 0097514 | 1/1984 | . | |
| 0137699 | 8/1985 | European Pat. Off. . | |
| 2456620 | 8/1976 | Fed. Rep. of Germany | 52/79.4 |
| 1083510 | 9/1967 | United Kingdom . | |
| 2115035 | 9/1983 | United Kingdom | 52/79.5 |

*Primary Examiner*—Charlie T. Moon

*Attorney, Agent, or Firm*—Merchant, Gould, Smith, Edell, Welter & Schmidt

[57] ABSTRACT

A method of producing a chamber assembly suitable for use in contaminated environments comprises arranging first and second chambers together, at or adjacent to the site at which they are to be used. Each chamber comprises a preformed enclosure comprising sheet material and support means for the enclosure and the chambers are arranged such that a side wall of the first chamber abuts a side wall of the second chamber. The abutting side walls are secured together and means are provided whereby the interior of at least one of the chambers is accessible without passing through the other chamber, and is also directly accessible from within the other chamber. A kit of parts for producing such an assembly, chambers for use in the method, and kits for producing such chambers are also described.

11 Claims, 7 Drawing Sheets

METHOD OF PRODUCING AN ASSEMBLY HAVING AT LEAST TWO INTERCOMMUNICATING CHAMBERS

This invention relates to chamber assemblies, and more particularly relates to a method of making such an assembly from individual chambers and to chambers for use in the method.

When workers are operating in areas where their clothing is likely to become heavily soiled and/or contaminated with dangerous substances, for example, asbestos, chambers are normally provided in which, on leaving the working area, soiled and/or contaminated clothing is exchanged for clean clothing or so-called "transit clothing" (that is, clothing that will contain any contaminant that remains on the worker's skin until the worker reaches a washing unit). In many cases it is desirable to provide more than one such chamber (for example, one for removing contaminated clothing, one for washing, and one for putting on clean clothing) and until now such chambers have generally been provided as a multi-chamber unit comprising a row of chambers.

Multi-chamber units of the above type are however cumbersome to transport, and may require more space than is readily available in the region of the working area. Furthermore such units are relatively expensive so that there is a tendency to continue using the unit even when the level of contamination makes discarding of the unit desirable.

The present invention provides a method of producing an assembly comprising first and second intercommunicating chambers which comprises arranging together, at or adjacent to the site at which they are to be used, first and second chambers having side walls and advantageously top and/or bottom walls, which chambers are preferably erected at the place where the assembly is to be made, each chamber comprising a preformed enclosure comprising sheet material and support means for the enclosure, a side wall of the first chamber abutting a side wall of the second chamber, and securing together, preferably in a releasable manner, the abutting side walls, means being provided whereby the interior of at least one of the chambers, preferably each chamber, is accessible without passing through the other chamber, and is also directly accessible from within the other chamber.

The invention also provides an assembly produced by the method of the invention, and a kit of parts for producing such an assembly. The kit of parts preferably comprises a collapsible enclosure and collapsible support means for each chamber, and means for securing the abutting walls of the chambers together.

An assembly produced in accordance with the invention may also comprise a third chamber having side walls and advantageously top and/or bottom walls and comprising a preformed enclosure comprising sheet material and support means for the enclosure, the third chamber being maintained with a side wall thereof abutting and secured to a side wall of the first chamber or the second chamber and the interior of the third chamber being directly accessible from within the chamber to which it is secured and, preferably, also being accessible without passing through the first chamber or the second chamber. Where there are three chambers, these need not be arranged in a straight line. Thus, for example, the three chambers may be arranged to give an "L"-shape.

It will be appreciated that an assembly according to the invention may comprise more than three chambers and that any desired number of chambers can be used to provide, for example, a series of chambers each of which is accessible from the next, at least the interiors of the chambers at the ends of the series being accessible from outside the assembly. The invention is not however restricted to arrangements wherein each chamber, apart from the two end chambers, communicates directly with two other chambers, (for example, "branched" arrangements are possible), and any arrangement of chambers that is appropriate to the circumstances in which the assembly is to be used may be adopted.

For simplicity the invention will generally be described in terms of first and second chambers, but it will be understood that, unless this is clearly inappropriate in the circumstances, statements concerning the first and second chambers and the relationship between them apply equally to the third chamber and the relationship between and the securing together of the first or second and third chambers, if a third chamber is present, and so on.

The invention also provided a chamber for use in the method and assembly of the invention, which chamber comprises a preformed enclosure comprising sheet material and support means for the enclosure, the support means comprising a plurality of elements each extending between spaced apart surfaces and comprising means urging the element into contact with the spaced apart surfaces, and a kit of parts that may be assembled to form such a chamber The invention further provides a chamber for use in the method and assembly of the invention, which chamber comprises a preformed enclosure, support means for the enclosure, the support means comprising a self-supporting frame positioned outside the enclosure, and resilient ties securing the enclosure to the frame, and a kit of parts that may be assembled to form such a chamber.

The invention also provided a chamber for use in the method and assembly of the invention, which chamber comprises a preformed enclosure and a self-supporting frame, positioned outside the enclosure, forming support means for the enclosure, the frame comprising means whereby a part thereof can also act as part of the support means for a further member, and a kit of parts that may be assembled to form such a chamber.

In an assembly produced according to the invention, a side wall of the first chamber abuts a side wall of the second chamber, and it will be appreciated that the profiles of the said side walls must be such as to make such an abutting relationship possible. In the interests of ease of making the assembly and maximum versatility in the arrangement of chambers, each chamber preferably has at least three substantially planar side walls. Advantageously each chamber has four substantially planar sides, and is preferably substantially square in plan.

In the situation for which the invention is particularly useful, that is, where the purpose of the assembly is to prevent undesired substances from being transferred, for example, on clothing, to a region outside a working area, the assembly will normally require top and bottom walls. While such walls could if desired be provided by the ceiling and floor respectively of the area in which the assembly stands (for example, the side walls of each chamber could be taped to the ceiling and floor), each enclosure preferably has a top wall and a bottom wall formed of sheet material, the top and bottom walls advantageously being formed in one piece with the side walls. When, as is preferred, the enclosures are square in plan each enclosure advantageously comprises four elongate hexagons of sheet material, each elongate hexagon providing a side wall and a part of each of the top and bottom walls of the enclosure.

The sheet material used for the preformed enclosure is preferably a plastics material, advantageously heavy duty polyethylene, typically approximately 1000 g white polyethylene, but may if desired be of a textile material. The sheet material is flexible, and is advantageously sufficiently flexible to enable the enclosure to be packed, for example by folding, in a relatively small space when not in use a s this facilitates transport and storage. Lengths of the sheet material may be joined together to form the enclosure by, for example welding (if the sheet is of plastics material) or by sewing if the sheet is of a textile material.

Each chamber comprises support means which, in use, supports the walls in the desired configuration, and any support means that achieves this may be used. Thus, for example, the support means may if desired comprise a frame which in use is positioned inside the enclosure, the enclosure in this case preferably comprising a top wall in addition to the side walls. The support means for each chamber is, however, advantageously positioned outside the enclosure. In this way contamination of the support means by substances inside the chambers may be avoided so that the support means may be reused without cleaning. Moreover, where the support means is positioned outside the enclosure, a single support element may form part of the support means for two or more chambers. The use of support elements that are common to two or more chambers can reduce costs and also reduce the weight of an assembly, which is of particular advantage when, as is preferred, the support means is collapsible and is intended to be carried from one site to another.

A number of different forms of support means that may be used in accordance with the invention are described below but, as indicated above, any other suitable form of support means may be used.

Where the assembly is to be used at a site having appropriate spaced apart surfaces, for example, floor and ceiling, the support means may comprise a plurality of elements each extending between the spaced apart surfaces and comprising means urging the element into contact with the spaced apart surfaces, there being a number of support elements appropriate to the shape of the chamber. Thus, for example, a chamber that is square or rectangular in plan would normally have four such support elements, one corresponding to each vertical edge.

Each support element advantageously comprises at least two members, preferably tubular members, of which at least one has an end section of reduced or enlarged diameter, which members may be telescopically engaged. The number and length of the members will be selected according to the space between the surfaces, e.g. the height between floor and ceiling.

Advantageously, the combined length of at least one pair of members of the support element may be varied, advantageously continuously, and means are provided whereby the said combined length may maintained at a desired value. This may be achieved, in the case of a pair of telescopically engaging members, by a thumbscrew inserted through a threaded aperture in the outer member, the end of the screw engaging the outer surface of the inner member.

The support element may be biassed into extending its length by means, for example, of a compression spring. This may be positioned, for example, within the outer member of a pair of telescopically engaged members or within a ferrule which is telescopically mounted on the uppermost support member. The uppermost end of the support element is preferably covered by a upper cap which reduces the danger of slipping on and/or damage to the upper support surface, e.g. the ceiling.

While support means of the above type may be advantageous in some circumstances, in many circumstances it is advantageous if the support means is self-supporting, that is, it does nor rely on the presence of an upper support surface A self-supporting support means may, for example, be in the form of a free-standing frame which may comprise a plurality of upright support elements and a plurality of elements, for example, horizontal elements spacing apart the upright elements. Advantageously, means are also provided for bracing the upright support elements against tilting.

A preferred self-supporting support means for use in accordance with the invention comprises upright elements, horizontal elements, and connector elements which both connect together uptight and horizontal elements and also brace the uptight elements against tilting. When, as is preferred, the enclosure is substantially square in plan, a free-standing frame preferably comprises four upright support elements (each of which may, if desired, be made up of two or more sections connected together in any suitable manner), eight horizontal elements (four at the top and four at the bottom of the frame) and eight corner connector elements, each of which comprises at least three tubular elements at right angles to each other. Such a connector element can be arranged to receive the ends, which are preferably of a reduced diameter, of an upright support element and ends of two horizontal support elements and, if the tubular elements are of sufficient length and rigidity, will also brace the frame so that there is little or no tendency for the upright elements to rock relative to the horizontal elements.

If desired withdrawal of a support element from a connector element may be prevented by, for example, providing the support element with an outwardly biased protrusion adjacent to its end, the protrusion being depressed by the passage over it of a portion of the connector element until it is aligned with a hole in the connector element; engagement of the protrusion in the hole will then lock the parts against accidental displacement. Similar means may if desired be used to lock sections of a support element against accidental separation.

A self-supporting frame of the type described above could if desired be positioned inside the preformed enclosure. Preferably, however, the frame is of such dimensions that it can be positioned outside the enclosure, the enclosure being attached to the frame in such a way that the enclosure is maintained in the desired configuration.

Where the support means is positioned outside the enclosure it is possible, as indicated above, for a single support element to form part of the support means for two or more chambers. Where the support means comprises a plurality of support elements extending between spaced apart surfaces, for example, the floor and the ceiling, no special measures are normally required for this to be possible. Where however the support means comprises a self-supporting frame the provision of appropriate corner connector means will normally be desirable, for example, a corner connector element that can connect a single upright support element with horizontal elements of two or more chambers. For chambers that are square or rectangular in plan, 4- or 5-way connectors are preferably provided, 5-way being preferred as these permit maximum versatility in arrangement of the chambers. Thus if a first chamber that is square or rectangular in plan is erected using a 5-way connector at each corner the second chamber may abut any of the four side walls of the first chamber.

When a chamber is being erected, the preformed enclosure and the support means may be associated together in any manner that permits the support means to maintain the enclosure in the desired position and shape. Thus, if the support means comprises a free-standing frame for positioning inside the preformed enclosure there may be no need for separate means for securing the walls to the frame. Where, as is preferred, the support means is outside the walls, securing means will normally be required. A preferred securing means comprises a plurality of resilient ties each of which is attached both to the enclosure and to the support means. Resilient ties tend to absorb shocks to the chamber, thus reducing the risk of the sheet material being punctured. Advantageously the enclosure is releasably attached to the support means.

In a multi-chamber assembly according to the invention, the abutting side walls of the first and second chambers are secured together and the interior of at least one of the chambers is accessible from outside the assembly without passing through the other chamber, and is also directly accessible from within the other chamber.

To facilitate the securing together of adjacent chambers, and also to facilitate the provision of access to the interior of the chambers, at least one chamber, and advantageously each chamber, preferably has a door aperture in a side wall thereof, that is, in a side wall of the respective enclosure. When making the assembly the aperture-containing side wall of the first chamber is advantageously the side wall that abuts a side wall of the second chamber. When this is the case, a worker inside the first chamber can secure the sheet material surrounding the aperture to the adjacent side wall of the second chamber by, for example, adhesive tape that overlaps the edge of the door aperture, being stuck to the interior of the side wall of the first chamber (around the aperture) and to the exterior of the abutting side wall of the second chamber.

If desired, a door aperture could be cut in each chamber immediately before positioning the chambers together. Preferably, however, there is a preformed door aperture in each enclosure. This not only reduces the time required for making the assembly but also ensures that the aperture is in the optimum position in the wall and is of the optimum size and shape.

When the sheet material surrounding a door aperture has been secured to an abutting side wall of an adjacent chamber, an opening can be made in the abutting side wall in register with the door aperture. Preferably an "I"-shaped slit is made in the abutting side wall to form two rectangular flaps which can if desired be passed through the door aperture and then folded back and secured, for example, by adhesive tape, to the interior wall of the first chamber.

In the arrangement described above, the door aperture in the first chamber and the opening in the second chamber together form the means providing direct access between the interiors of the first and second chambers. Furthermore the securing of the material surrounding the door aperture in the first chamber to the abutting side wall of the second chamber secures the two chambers together. If flaps of the material forming the said side wall of the second chamber are folded back and secured inside the first chamber as described above, this also assists in securing the chambers together.

Preferably, each chamber has a single preformed door aperture therein. In an assembly comprising two such chambers the door aperture of the first chamber will abut a side wall of the second chamber, and it will be necessary for the worker making the assembly to cut an opening in a side wall of the first chamber if access to the interior of that chamber from outside the assembly is required. Access to the interior of the second chamber from outside the assembly is provided by the preformed door aperture in the second chamber.

Working areas in which clothing is likely to become heavily soiled and/or contaminated, that is, areas in connection with which the assembly of the invention is particularly useful, are usually surrounded by a screen that protects neighbouring areas from undesired substances such as dust or particles of noxious materials. Where there is a screen, the assembly of the invention is preferably outside the screened area, although this is not essential and the assembly may instead be inside the enclosure, or partly inside the enclosure and partly outside, or may form part of the screen. Preferably there is direct access from the screened area to the interior of the assembly.

In a particularly advantageous arrangement a side wall of one of the chambers, preferably the second chamber, or where there are more than two chambers, the last chamber in a series of chambers, is maintained in abutting relationship with the screen and there is direct access from the working area to the interior of the said chamber. Preferably, the chamber side wall that abuts the screen has a door aperture therein, and the steps indicated above in connection with the first and second chambers are taken for maintaining the chamber in abutting relationship with the screen and for providing access between the working area and the interior of the chamber.

In many cases, it is not possible to position the desired chamber of the assembly close enough to the screen to enable the abutting side wall of the assembly to be reliably secured directly to the screen. If this is the case extension means may be provided to bridge the gap between the wall and the screen. For example, each corner of the door aperture may have a generally triangular piece of plastics material connected thereto so that when a slit is made in the sheet material diagonally outwards from each corner of the aperture gussets are formed and the sheet material forming the side wall may be folded outwardly to form an integral extension which can bridge the gap between the chamber wall and the screen. Other forms of extension, for example, non-integral extensions, could of course be used if desired, but the integral extension described above is particularly advantageous as, except where the gusset is attached, it is not necessary to attach the extension to the chamber wall.

In certain instances the provision of a single chamber is sufficient to meet all safety requirements. The invention thus also provided a combination comprising a screen which forms a boundary of a working area, and a chamber, which has preferably been erected on site, maintained in abutting relationship with the screen, the chamber comprising a preformed enclosure comprising sheet material and support means for the enclosure and the interior of the chamber being accessible from the working area and from an area outside the working area.

In a typical arrangement according to the invention the assembly comprises a series of three chambers positioned outside a screened working area with the third chamber abutting and secured to the screen (via an extension if necessary) and with its interior accessible from the working area. A worker wishing to leave the working area can leave soiled or contaminated clothing in the third chamber, wash in the second chamber, and put on clean clothing or transit clothing in the first chamber, leaving the assembly through an opening in a side wall of the first chamber. A number of advantages of the present invention can be discussed with reference to this typical arrangement.

As indicated above, series of chambers have in the past been provided as multi-chamber units comprising a row of chambers. Such units can only be used where there is sufficient space to accommodate them. Furthermore, the entire unit must be discarded when one chamber reaches a specified level of contamination. In accordance with the present invention, however, individual chambers can readily be erected on site by relatively unskilled workers from a kit comprising the preformed enclosure and the support means, and the chambers can then be used to make an assembly in which the number of chambers, and their arrangement relative to one another, can be chosen having regard to the level of contamination and the space available to accommodate the assembly. Furthermore, as the preformed enclosures and the support means may be such that they can be folded or collapsed as appropriate and packed into a portable container, transport is easy and relatively little space is required for storage.

The fact that in accordance with the invention the assembly may be made on site by releasably securing together the required number of individual chambers has the additional advantage that when one chamber in the series becomes unacceptably contaminated that chamber may be detached from the rest of the assembly, and from the screen if necessary, and replaced by a different chamber. In the typical arrangement described above, the third chamber will become contaminated most quickly and will be removed first. On removal of the third chamber, the second may take the place of the third and the first of the second, the new chamber then becoming the first in the series. Where, however, as is preferred in many circumstances, there is an extension between the third chamber and the screen, the new chamber advantageously has an extension and becomes the third in the series.

It will be appreciated that the above procedure is particularly simple if the support means for each chamber is outside the chamber as in that case the support means will not become contaminated and only the preformed enclosure need be removed. If, as is preferred, the enclosure has top and bottom walls as well as side walls, the contaminated clothing can simply be removed in the enclosure, thus eliminating the need to handle the clothing. Furthermore, because in accordance with the invention the preformed enclosure may be made of a relatively inexpensive material, for example, polyethylene, it can be economically viable simply to discard an enclosure after contaminated clothing has been removed in it, if safety requirements call for this.

Two chambers constructed in accordance with the invention, and the use in accordance with the invention of a plurality of chambers to form an assembly, will now be described, by way of example only, with reference to the accompanying drawings, in which.

Figure 1:
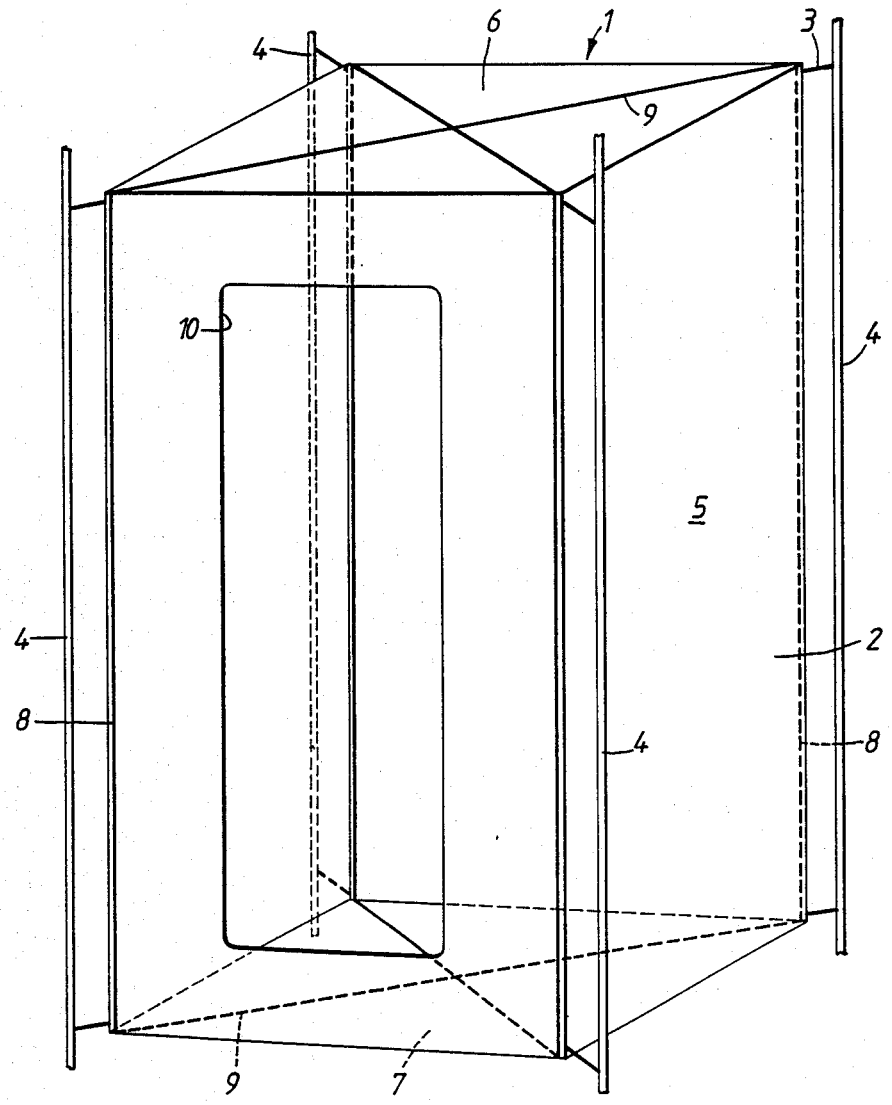
FIG. 1 shows a preformed enclosure for use in a chamber according to the invention and also shows, in diagrammatic form, part of a support means therefor.

Referring now to the drawings, and more particularly to FIG. 1, a chamber indicated generally by the reference numeral 1 comprises a preformed enclosure 2 secured by ties 3 to four support elements 4. The support elements form a collapsible support means which abuts between floor and ceiling.

Figure 2:
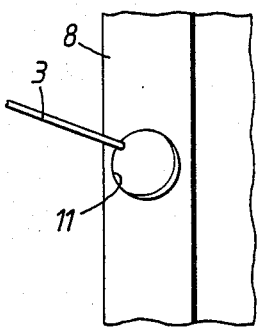
FIG. 2 shows one form of means for attaching a preformed enclosure to a support means.

The preformed enclosure, which is formed of a flexible sheet plastics material, for example heavy duty polyethylene, and can readily be folded or rolled for transport and storage, comprises four rectangular side walls 5, arranged with the longer sides vertical, and square top and bottom walls, 6 and 7 respectively. The enclosure comprises four elongate hexagons, of identical size and shape, of sheet material. The long sides of the hexagons are welded at 8 to provide corner seams (extending substantially vertically in use) of the enclosure, while the triangular end portions of the elongate hexagons are welded at 9 to the adjacent hexagons to form the top and bottom walls 6 and 7 respectively of the enclosure. One side wall of the enclosure has a door aperture 10 therein. As shown in FIG. 2 and explained in more detail below, the corner seams 8 have eyelets 11 therein (not shown in FIG. 1). One method of forming an enclosure 1 is described in more detail below with reference to FIG. 14.

Figure 3:
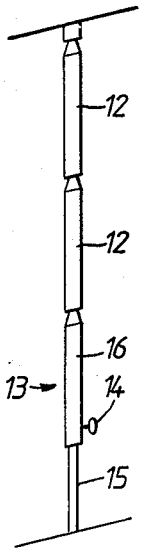
FIG. 3 shows one form of support element.
Figure 4:
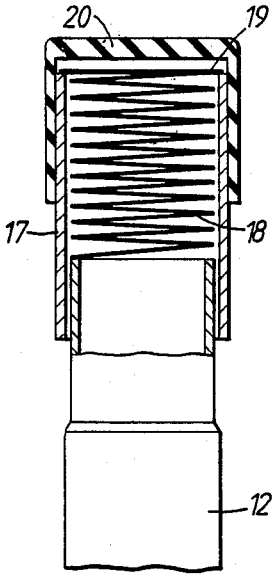
FIG. 4 is a cut-away view of the upper portion of the support element shown in FIG. 2.

One form of support element is shown in FIG. 3. In FIG. 3 each support element 4 comprises a plurality of sections 12, 13, the length of one of which, 13, can be adjusted by using a thumbscrew 14 to fix inner and outer telescopic portions, 15 and 16 respectively, in the desired positions relative to each other. The support element can thus readily be assembled in situ and adjusted to the desired height. Thus, after making sure that the internal portion 15 of the adjustable section 13 is withdrawn entirely into the external portion 16 and secured by the thumbscrew 14, further sections 12 are installed on top of the adjustable section 13 and are pushed together, each section having an upper end of reduced diameter. As is shown most clearly in FIG. 4, the uppermost section comprises a spring-loaded device comprising a ferrule 17, one end of which is slidingly mounted on the end of reduced diameter of the uppermost section 12. Inside the ferrule is a compression spring 18 which at one end abuts the said end of reduced diameter and which at the other end has an enlarged end coil 19 which rests on the free end of the ferrule. A rubber cap 20 is provided over the free end of the ferrule to reduce the danger of slipping on and damage to a support surface.

Figure 5:
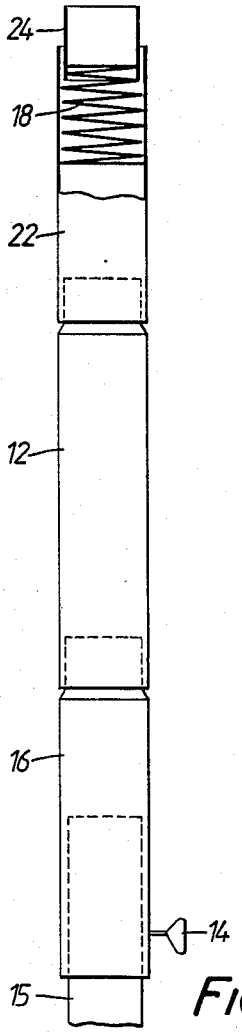
FIG. 5 shows another form of support element.
Figure 6:
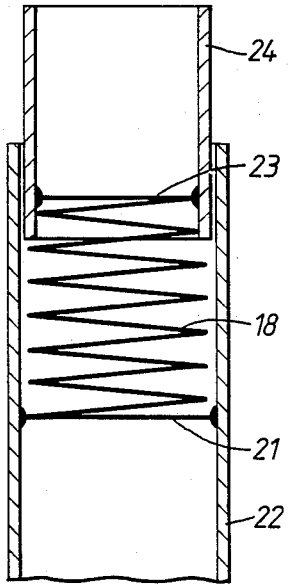
FIG. 6 shows an enlarged, cut away, view of a portion of the support element shown in FIG. 5.

A further location for the biasing means, e.g. the compression spring 18, is illustrated in FIGS. 5 and 6, in which one end portion 21 of the spring is fixedly mounted on an interior surface of one section 22 of a telescopic member, at a location spaced from an end of the section 22, the other end portion 23 of the spring being fixedly mounted within the interior of another section 24 of the telescopic member.

When all the sections of a support element have been pushed together, the support element is raised until the upper end thereof butts against the ceiling. The thumbscrew 14 is then loosened allowing the inner portion 15 of the adjustable section to drop onto the floor. The sections are pushed hard up against the ceiling, which comprises the spring, and the thumbscrew is retightened. The pressure of the compressed spring will keep the sections rigidly in place without further mechanical attachments.

When assembling a chamber according to the invention four support elements 4 may be erected in the positions desired for the corners of the chamber. The collapsible enclosure 2 is then releasably secured to the support elements by a plurality of ties 3 each of which comprises an elastic band, which is threaded through itself and passes round and frictionally engages a support element, and a hook which engages the band and an eyelet 11, shown in enlarged form in FIG. 2, formed in a corner weld 8 of the enclosure. Ties are situated at or near the top and bottom of each vertically extending corner seam 8 and advantageously each corner seam has associated with it further ties (typically two) spaced evenly along the length of the seam. The further ties are not shown in FIG. 1.

It will be appreciated that the above arrangement, wherein a collapsible enclosure is releasably secured to support elements positioned outside the enclosure makes it possible to replace one enclosure by another without disturbing the support elements. The same is true of the arrangement shown in FIG. 7, which shows a support means in the form of a self-supporting, free-standing frame.

The free-standing frame, indicated generally by the reference numeral 30, is capable of supporting three preformed enclosure means that are square in plan (to form a three-chamber assembly) and comprises upright support elements 31, horizontal support elements 32, and 5-way corner connector elements 33. Each of the upright elements is itself formed from two sections 34 and 35 joined together by a reduced diameter end portion of one being received in the open end of the other, and the upright elements are approximately twice the length of the horizontal elements.

The support means for each chamber comprises four upright elements 31 and eight horizontal elements 32 (four horizontal elements defining the top of the frame and four defining the bottom), with a 5-way connector 33 at each corner.

Figure 8:
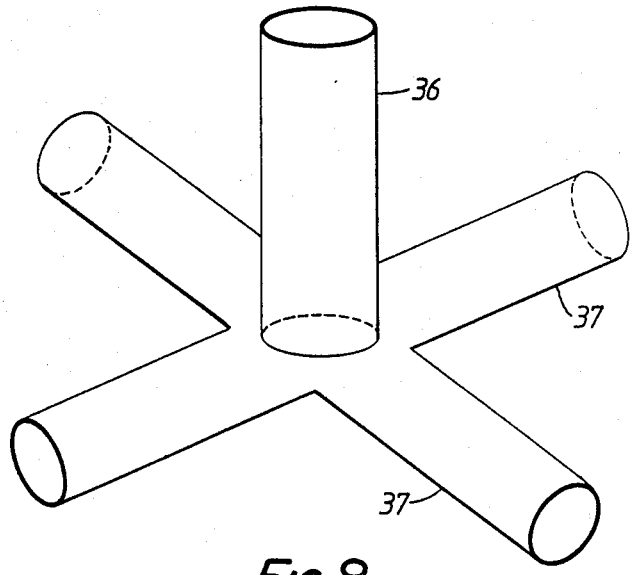
FIG. 8 shows a corner connector element suitable for use in the support means of FIG. 5.

A suitable 5-way connector for the frame of FIG. 5 is shown in more detail in FIG. 8 and has a vertical portion 36 and four horizontal portions 37, each horizontal portion 37 bring at right angles to the vertical portion 36 and to the two adjacent horizontal portions. The corner connectors at the bottom of the frame will of course be used in the orientation shown in FIG. 8, while those at the top of the frame will be inverted so that the vertical portions extend downwards. Each of the five portions of the connector is tubular and is relatively rigid so that it can both receive an end of a support element and impart rigidity to the structure as a whole.

Figure 7:
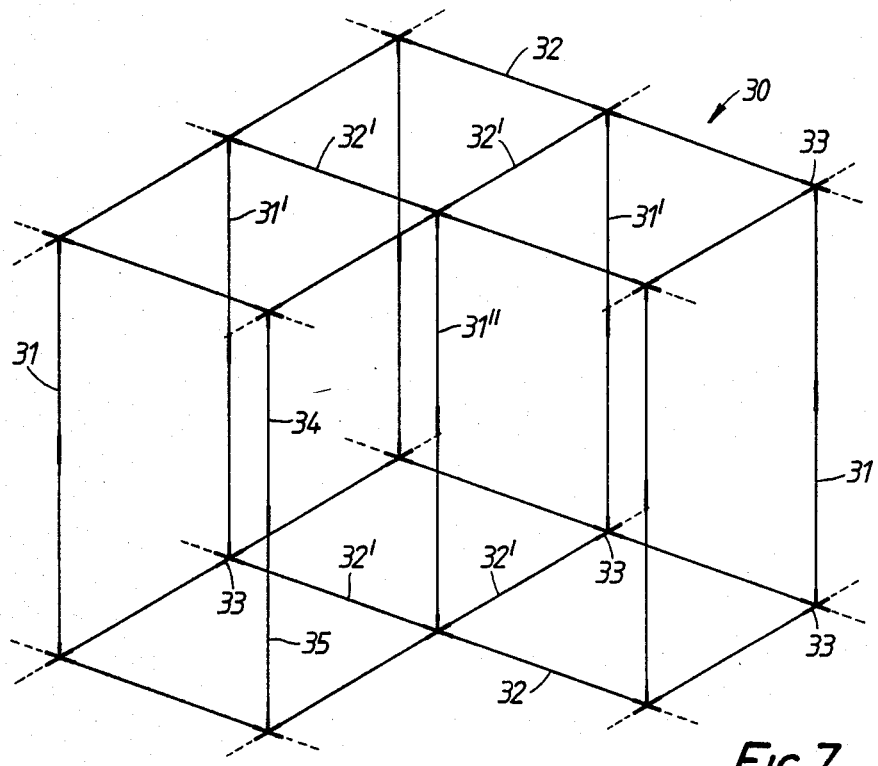
FIG. 7 shows a support means having the form of a self-supporting frame.

In the frame structure shown in FIG. 7, certain of the vertical and horizontal support elements, designated 31' and 32' respectively are common to the support means of two of the chambers, and one of the vertical support elements, designated 31'', is common to the support means of all three of the chambers, thus reducing the number of support elements required and the time required to erect an assembly. Furthermore, as indicated by the dotted lines, support means of additional chambers can be added to any desired face of the 3-chamber assembly so that any desired arrangement of the support means, and thus of the chambers, can be obtained.

The frame structure shown in FIG. 7 can be used with any suitable preformed enclosure, for example, the preformed enclosure 2 shown in FIG. 1, and any desired means, for example, the elastic ties 3 shown in FIG. 2, can be used for attaching the preformed enclosure to the frame.

Figure 9:
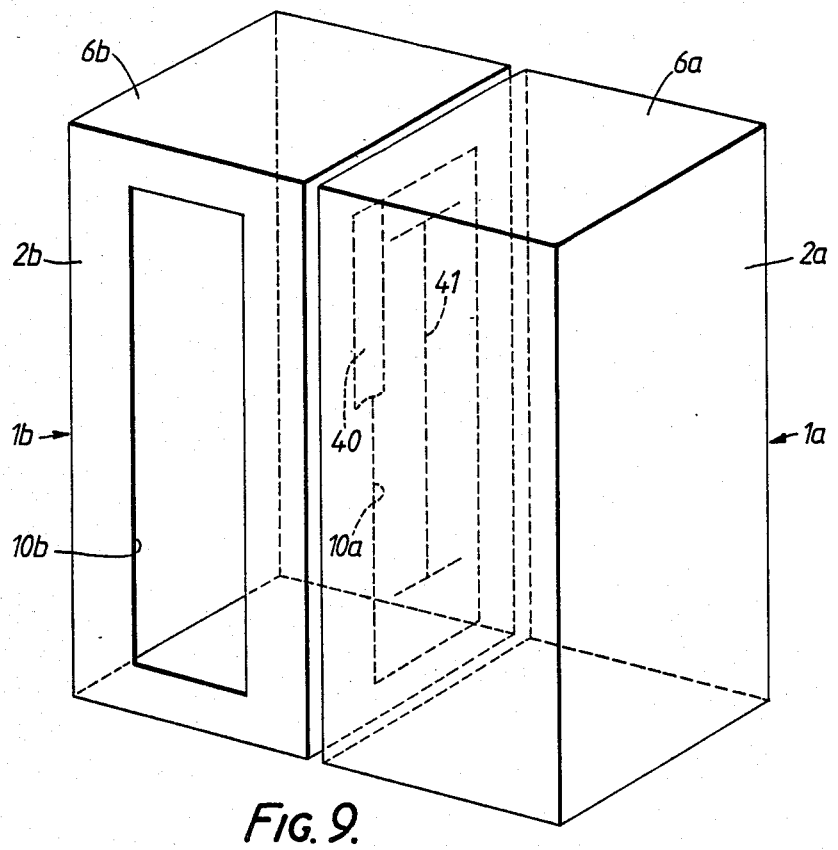
FIG. 9 shows an assembly according to the invention comprising two chambers.

FIG. 9 illustrates one way in which an assembly according to the invention can be made. For simplicity the chambers are shown in diagrammatic form and the support means for the preformed walls are not shown.

The two chambers shown in FIG. 9 are identical, each having square top and bottom walls and rectangular side walls, one side wall of each chamber having a door aperture therein. In FIG. 9 the same reference numerals are used as in FIG. 1, the letter "a" being used to denote those relating to the first chamber (the right-hand chamber in FIG. 9) and the letter "b" being used to denote those relating to the second chamber (the left-hand chamber in FIG. 9).

When making the assembly shown in FIG. 9 the side wall of the first chamber **1*a* that contains the aperture 10*a* is positioned against a side wall (any side wall, apart from that containing the aperture) of the second chamber 1*b*, and an opening (not shown in FIG. 9) is cut in another side wall of the first chamber to provide access to that chamber. It will be appreciated that the side wall in which the opening is cut can be chosen at will, having regard to the situation of the first chamber, thus contributing to the versatility of the method of the invention. A worker inside the first chamber then tapes the door aperture 10*a* of the first chamber to the adjacent side wall of the second chamber by means of overlapping tape 40. In the interests of clarity FIG. 9** shows only a short length of the tape, but it will be appreciated that in practice it will normally be desirable to tape round the entire door aperture, thus forming a secure and dust-tight connection between the two chambers.

An opening 41 is then made in the part of the wall of the second chamber that is framed by the taped aperture, thus providing access between the interiors of the two chambers. In FIG. 9, this opening is provided by cutting an "I"-shaped slit in the wall in question. If the horizontal parts of the slit are long enough the rectangular flaps of material formed may be folded back along vertical lines and secured, for example, by tape, to the inner wall of the first chamber.

Figure 10:
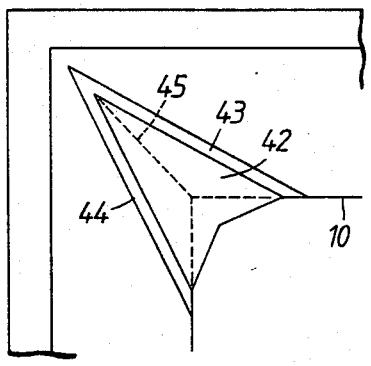
FIG. 10 shows an extension gusset attached to a chamber side wall.
Figure 11:
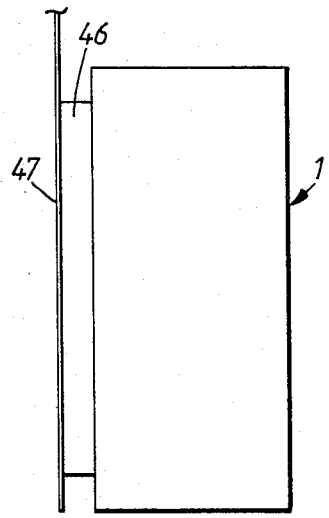
FIG. 11 is a side view of a chamber having an integral extension attached to a screen.

If an assembly comprising more than two chambers is required, the door aperture of the second chamber may then be taped to a side wall of a third chamber in the manner already described in connection with the first and second chambers. Similarly, the door aperture in the second chamber, or the last (or any other) chamber in the series, may if desired be taped to a screen surrounding a working area.

Where a chamber side wall is to be attached to a screen difficulties arise if the assembly cannot be positioned so that the side wall in question is close enough to the screen to be taped directly to the screen. FIGS. 10 and 11 show one manner in which this difficulty can be overcome.

As can be seen in FIG. 10 a triangular piece of sheet material 42 is attached (by welding if the sheet material is of a plastics material) along two of its edges 43, 44 to the side wall in the region of the corner of a doorway aperture 10, the lines of attachment forming a "V" the point of which lies on a line 45 which bisects the angle at the corner of the aperture, and the two arms of which terminate at the edge of the doorway aperture, one each side of the said line. The piece of material is of such a size, and is so attached, that it does not lie flush with the side wall and is capable of forming a gusset when a slit is made in the side wall along the line 45 from the corner of the aperture to the point of "V".

When an extension gusset has been formed at each corner of a doorway aperture the material of the side wall can be pushed out to form an integral extension the edges of which can then be taped to the screen. A side view of such an extension, 46, is shown diagrammatically in FIG. 11, the extension being taped to a screen 47.

Figure 12:
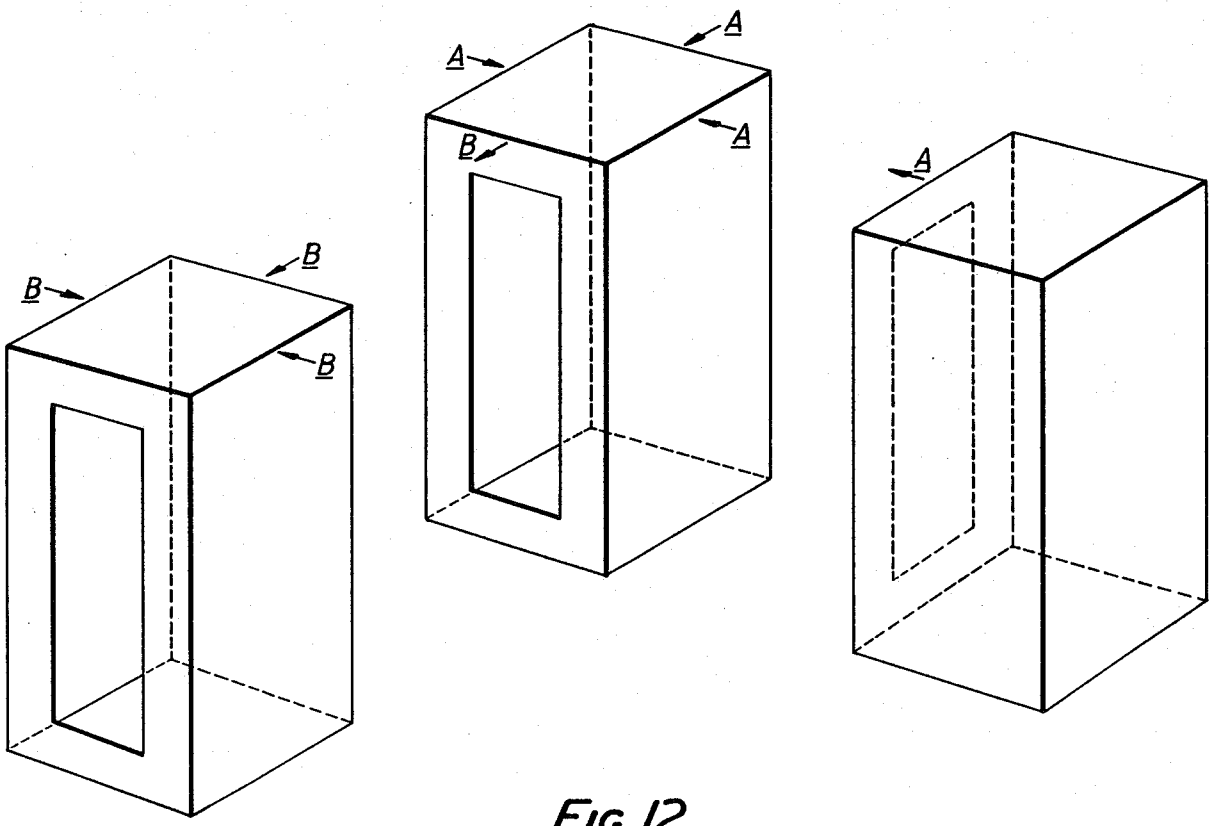
FIG. 12 illustrates the making of an assembly comprising three chambers.

As indicated above, the door aperture of the first chamber can be taped to any side (apart normally from that containing the door aperture) of the second chamber, and the same of course applies to the second and third and any subsequent chambers. This versatility of the assembly of the invention is illustrated diagrammatically in FIG. 12, where the side wall marked "A" can be secured to any side "A" of the adjacent chamber and, similarly, the side wall marked "B" can be secured to any side "B" of the next chamber. Where therefore there are three or more chambers it is not necessary for these chambers to be in a straight line, and the assembly can be designed to fit the space available.

Figure 13:
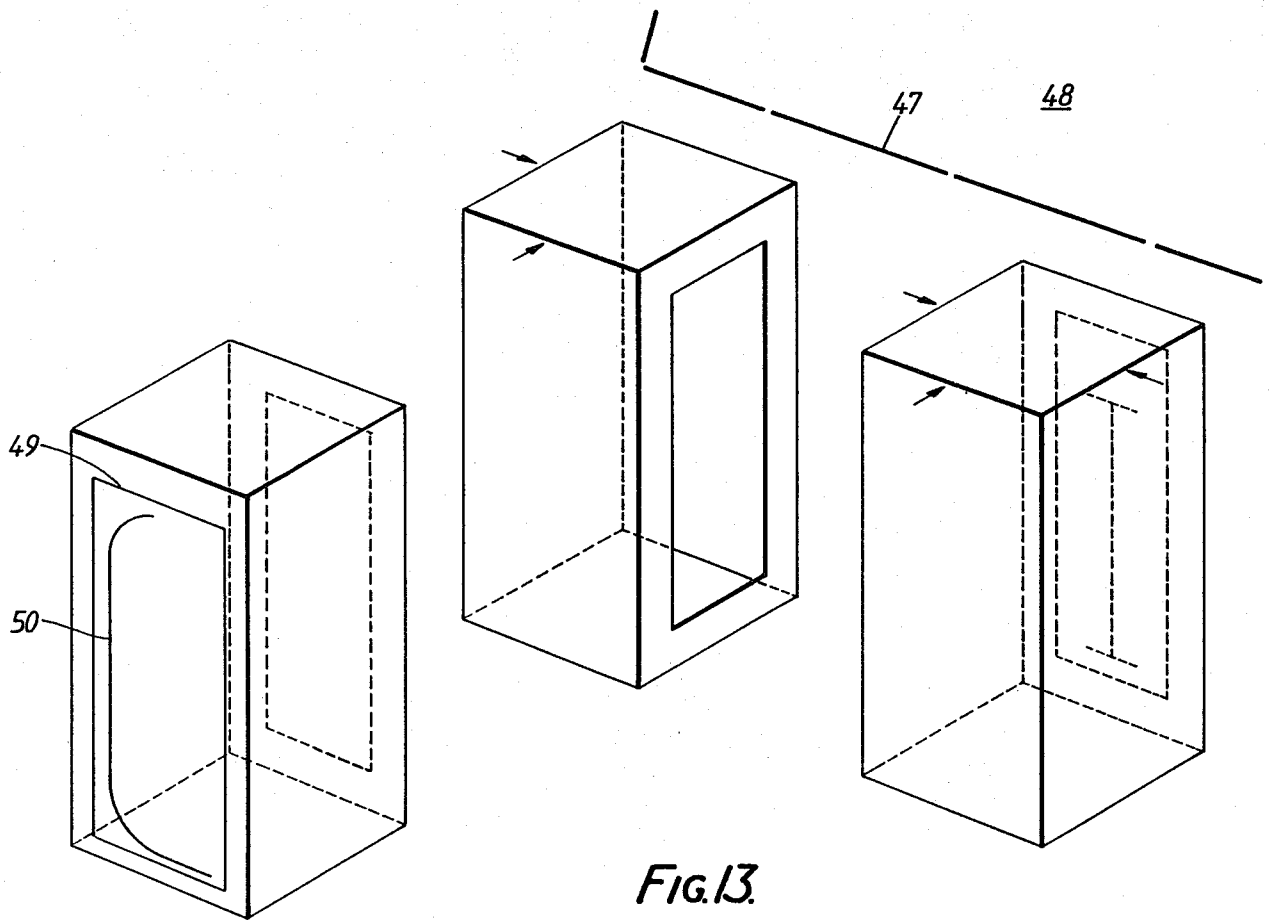
FIG. 13 illustrates the making of an assembly comprising three chambers. one of which is attached to a screen.

FIG. 13 illustrates diagrammatically one way in which an assembly can be built up-and attached to a screen 47 forming the boundary of a working area 48. It will be appreciated that the three chambers can be arranged in any desired manner. FIG. 13 also shows, in the left hand chamber, an optional door member 49 that may be provided by taping to a wall of the chamber a rectangular sheet of material having a zipped opening 50 therein, the wall then being cut along the line of the zipped opening to provide closable door means.

Typical dimensions for the enclosure shown in FIG. 1 are 0.9 m×0.9 m×2 m high, the doorway aperture being 0.45 m×1.8 m, with a 100 mm border at top and bottom and a 0.225 m border at each side. The side welds are typically approximately 40 mm wide, thus permitting the formation of an eyelet that is of an adequate size and which has a border of adequate width. Typical dimensions for a free-standing frame suitable for use with such an enclosure are 0.92 m×0.92 m×2.05 m high. The frame elements are suitable of zinc-plated tubular steel, having an external diameter of 22 mm.

Figure 14:
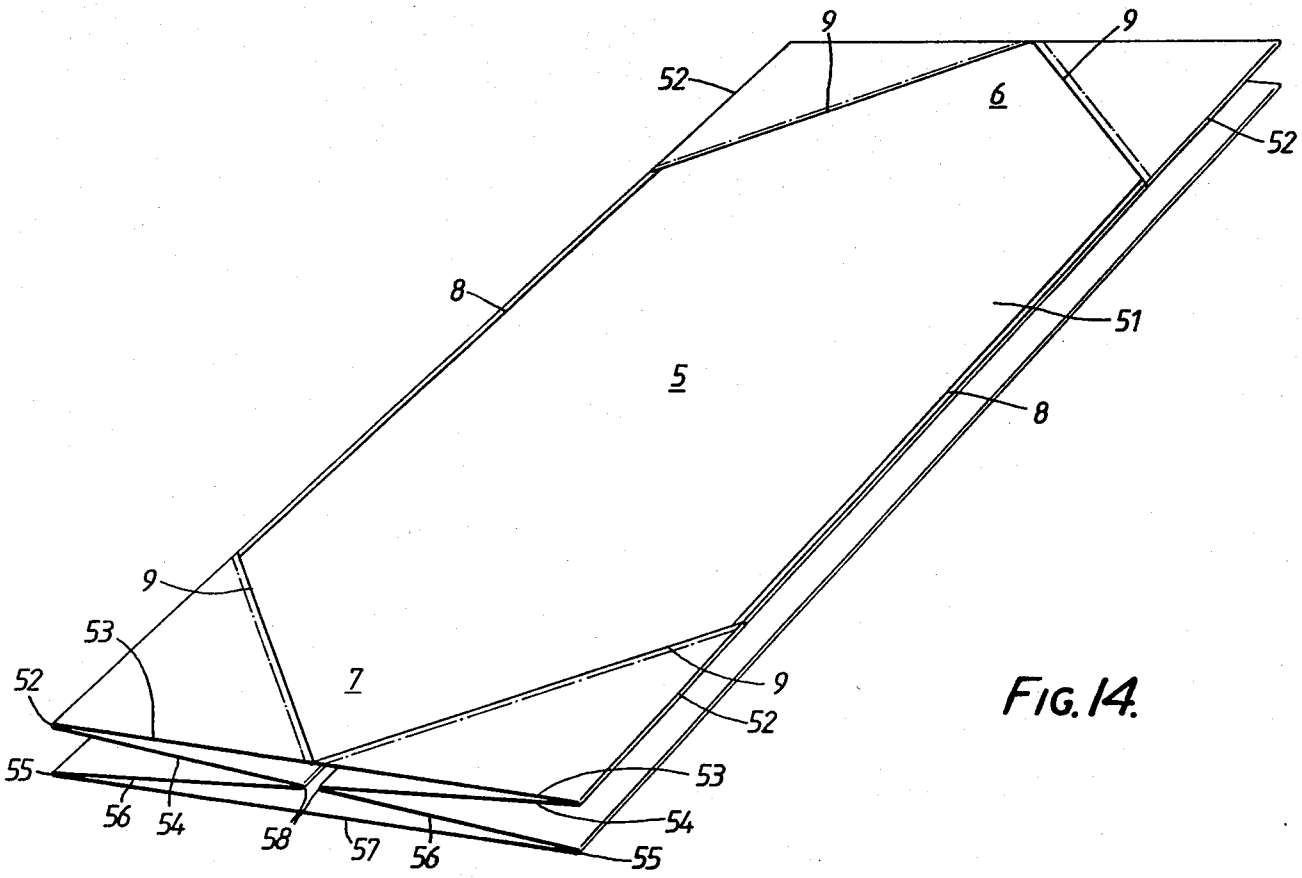
FIG. 14 illustrates one method of making the preformed enclosure shown in FIG. 1.

FIG. 14 illustrates one method of making the performed enclosure shown in FIG. 1 from folded tubular plastics material 51. The folded tubular material has four layers of material provided by six folds, each of which folds extends parallel to the longitudinal axis of the folded tubular material. Four of the folds lie at the sides of the folded material, two folds, 52, joining the first and second layers, 53 and 54, and the other two folds, 55, which lie beneath the folds 52, joining the third and fourth layers, 56 and 57. The second and third layers, 54 and 56 (the middle two layers) are joined by inverted folds 58 which abut each other and extend along the longitudinal axis of the folded material.

The first and second layers, 53 and 54, are welded together along the lines 8 and 9, as are the layers 56 and 57 (the welds for the layers 56 and 57 are not shown in FIG. 14). Each weld 9 extends, at an angle of 45° to the respective and of the folded material, from the centre of that end to a respective fold 52 or 54. The welds 8 are in the region of the folds 52 and 54 and extend between the points where the welds 9 meet these folds. The welds 8 strengthen the enclosure in the region of the folds 52 and 54 and, in particular, provide sites of adequate strength for the eyelets 11 shown in FIG. 2.

After formation of the welds 8 and 9 the corners of the folded tubular material are cut off along lines close to the welds 9 and the layers are opened out so that the enclosure has the form shown in FIG. 1. The aperture 10 may be cut in the sheet material before or after the folded material is welded and cut as described above.

I claim:

1. A method of producing an assembly having at least two intercommunicating decontamination chambers, said method comprising the steps of:

arranging together, at or adjacent to the site at which they are to be used, first and second chambers having side walls, each chamber comprising a preformed enclosure comprising flexible sheet material, a side wall of the first chamber abutting a side wall of the second chamber, securing together the abutting side walls, the assembly including support means for supporting the enclosures, and before, during or after the other steps, providing first means for accessing the interior of said first chamber without passing through said second chamber, and second means for directly accessing the interior of said second chamber from within the first chamber, said second means including an opening passing through abutting side walls of each of the first and second chambers, the provision of at least one of said first means and said second means including the step of cutting through at least one chamber side wall at or adjacent to the site at which the assembly is to be used.

2. A method as claimed in claim 1, wherein the support means for each chamber is positioned outside the preformed enclosure.

3. A method as claimed in claim 1, wherein each preformed enclosure is secured to its support means by resilient ties.

4. A method as claimed in claim 1, wherein said assembly includes a third chamber having third chamber side walls and comprising a preformed enclosure comprising flexible sheet material and third chamber support means for the enclosure said method further including arranging said third chamber with a third chamber side wall thereof abutting a side wall of one of the first and second chambers, securing said abutting side walls together, and providing third means for directly accessing the interior of the third chamber from within said one chamber.

5. A method as claimed in claim 1, which also comprises removing one of said chambers from the assembly and adding a further chamber.

6. A method as claimed in claim 1, wherein said first accessing means includes the interior of each chamber being accessible without passing through the other chamber.

7. A method as claimed in claim 1, wherein the support means for each chamber is positioned outside the preformed enclosure, the support means for each chamber comprises a plurality of support elements, and at least one support element is common to two or more chambers.

8. A method as claimed in claim 1, wherein a side wall of the first chamber has a pre-cut door aperture therein and the side wall containing the aperture is the side wall that abuts a side wall of the second chamber, and wherein the cutting step comprises cutting an opening in the said wall of the second chamber in register with the said pre-cut door aperture of the first chamber, the said aperture and the said opening providing the access between the interiors of the first and second chambers.

9. A method as claimed in claim 8, wherein the cutting step also comprises cutting an opening a side wall of the first chamber that does not contain the pre-cut door aperture to provide access to the interior of the first chamber within passing through the second chamber.

10. A method as claimed in claim 4, wherein the three chambers do not lie straight line.

11. A method as claimed in claim 1, which also comprises arranging a side wall of one of the chambers in abutting relation with a screen forming a boundary to a working area and securing the said side wall to the screen, means being provided whereby the interior of the said chambers is accessible form the working area.

* * * * *